US005421057A

United States Patent [19]

Stang

[11] Patent Number: 5,421,057

[45] Date of Patent: Jun. 6, 1995

[54] CLEANING PROCESS AND DEVICE

[75] Inventor: Bernhard Stang, Kipfenberg, Germany

[73] Assignee: Rieter Ingolstadt Spinnereimaschinenbau AG, Ingolstadt, Germany

[21] Appl. No.: 100,042

[22] Filed: Jul. 29, 1993

[30] Foreign Application Priority Data

Aug. 11, 1992 [DE] Germany ..... 42 26 406.5

[51] Int. Cl.[6] ..... A47L 7/00

[52] U.S. Cl. ..... 15/308; 15/309.1

[58] Field of Search ..... 15/306.1, 308, 309.1; 134/21; 361/221

[56] References Cited

U.S. PATENT DOCUMENTS

| | | | |
|---|---|---|---|
| 1,089,453 | 3/1914 | Wood | 15/308 |
| 1,237,047 | 8/1917 | Howell | 15/308 |
| 1,926,306 | 9/1933 | Pettersen | 15/309.1 |
| 3,453,681 | 7/1969 | Wiederhold | 15/306.1 |
| 3,546,733 | 12/1970 | Johnson | 15/308 |
| 4,403,370 | 9/1983 | Volkmann | 15/309.1 |
| 4,783,947 | 11/1988 | Posey | 15/309.1 |

FOREIGN PATENT DOCUMENTS

| | | |
|---|---|---|
| 2634770 | 2/1979 | Germany . |
| 1557374 | 12/1979 | United Kingdom . |

*Primary Examiner*—David A. Scherbel
*Assistant Examiner*—Terrence R. Till
*Attorney, Agent, or Firm*—Dority & Manning

[57] ABSTRACT

The invention relates to a process and to a device for the cleaning of a textile machine belt by means of a suction pipe. The belt is taken through the suction pipe and is subjected to suction. The suction pipe is provided with two slits for that purpose, by means of which the suction pipe surrounds the belt.

7 Claims, 4 Drawing Sheets

CLEANING PROCESS AND DEVICE

BACKGROUND OF THE INVENTION

In spinning machines belts are used for the greatest variety of applications. In a rotor spinning machine according to DE 26 34 770 A1 for example, flat belts are used to remove dirt particles from a spinning station to a suction source. These dirt conveyor belts are freed from dirt by means of suction nozzles. The suction nozzles are located at the top of the conveyor belt or, in a better embodiment, on the upper and lower side of the conveyor belt. This is to ensure that as few dirt particles as possible may adhere to the conveyor belt and be again conveyed to the spinning machine. It is a disadvantage in this known device that the conveyor belt cannot be kept completely free of dirt. Therefore, dirt particles are fed to the spinning station and cause errors in the produced yarn.

Flat belts are furthermore used in draw frames to drive draw frame rollers. Here too attention must be given to great cleanliness required of the flat belts. Adhering dirt particles may cause a change in the translation conditions of the belt and thus lead to faulty drafting of the fiber slivers to be drawn.

OBJECTS AND SUMMARY OF THE INVENTION

It is a principal object of the instant invention to create a device to clean belts in spinning machines which ensures complete cleaning of the belt from adhering dirt particles. Additional objects and advantages of the invention will be set forth in part in the description which follows, or may be obvious from the description, or may be learned by practice of the invention.

According to the present invention, if the belt is taken through a suction pipe and subjected to suction, optimal cleaning of the belt is ensured. The belt is in this case subjected to suction on all sides, i.e. on the surfaces as well as on the lateral faces. The belt is thereby cleaned advantageously on all sides and dirt is prevented from being fed again to the spinning machine. Especially good cleaning is achieved if the belt is scraped off and/or brushed against the suction pipe. This mechanical influence upon the belt in addition to the pneumatic suction increases the cleaning effect.

The device to carry out the process is designed so that the suction pipe is provided with two slits. The belt is introduced into the suction pipe through these two slits and is again removed from the suction pipe through them. An excellent cleaning effect is achieved through this simple device.

It has proven to be advantageous for the slits to be oriented in the axial direction of the suction pipe. Uniform subjection of the upper and under side of the belt to suction is thereby ensured. If the slits are located at the end of the suction pipe, a very simple assembly of the suction pipe on the belts is possible. The belt can be pushed into the slits from the side without disassembling the suction pipe or the endless belt. If the end of the suction pipe is closed with a cover, good suction on the face of the belt which is away from the suction point is achieved. Furthermore, the required suction air is reduced by closing off the suction pipe by means of the cover.

Different sizes of the slits on the suction pipe facilitate the feeding of rough dirt particles into the suction pipe and reduce the overall air consumption.

By providing mechanical cleaning devices in addition to the pneumatic suction, particularly intensive cleaning is achieved. A brush which is preferably located at the slit for the exit of the belt has proven to be an advantageous mechanical cleaning device.

DETAILED DESCRIPTION OF THE PREFERRED EMBODIMENTS

Figure 1:
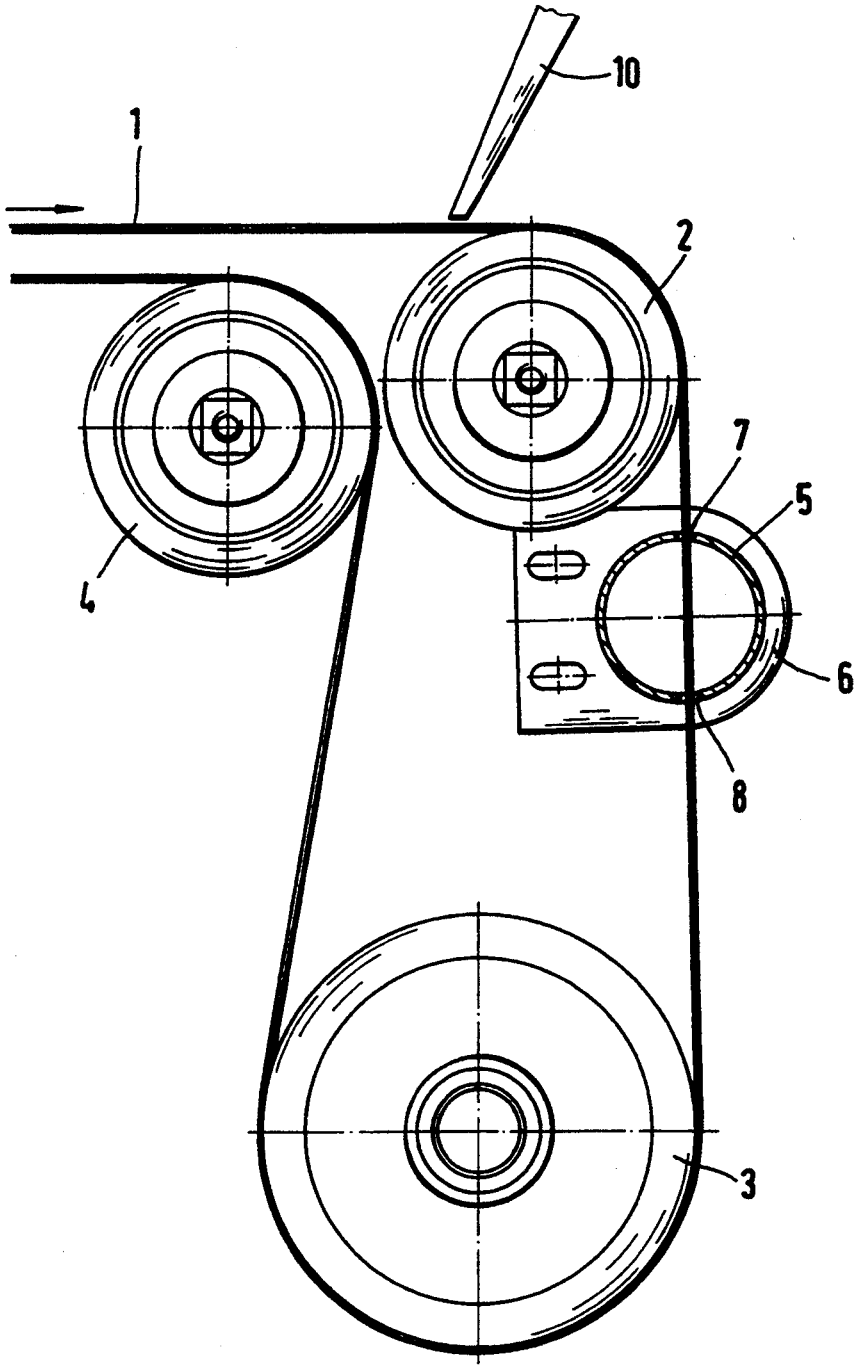
FIGS. 1 and 2 each show a device for the cleaning of a belt according to the invention.

Reference will now be made in detail to the presently preferred embodiments of the invention, one or more examples of which are illustrated in the drawings. Each example is provided by way of explanation of the invention, not limitation of the invention. In fact, various modifications and variations can be made in the present invention without departing from the scope or spirit of the invention. The numbering of components in the drawings is consistent throughout the application, with the same components having the same number.

FIG. 1 shows a device for the deflection of a dirt conveyor belt in an open-end spinning machine. A conveyor belt 1 is guided around deflection rollers 2, 3, 4. Dirt particles which have accumulated at the opener rollers at the different open-end spinning stations are removed on the upper trunk of the conveyor belt 1. The dirt particles arrive at the shown deflection location at one end of the open-end spinning machine and are there sucked away for the major part by a suction nozzle 10. Following the suction nozzle 10, the conveyor belt 1 runs through a suction pipe 5. The suction pipe 5 is slit at its end, at sides facing each other, so that the conveyor belt 1 can be guided through the suction pipe. The slits 7 and 8 face each other radially in the shown embodiment. However, in case of constantly greater soiling of one side of the conveyor belt 1, the invention also provides for a suction pipe 5 with slits 7 and 8 which do not guide the belt through the center of the suction pipe 5, but guide it with a certain offset thereto. As a result the suction pipe diameter is increased on one side of the conveyor belt so that greater quantities of dirt and particles are easier to remove. The suction pipe 5 is secured to the machine frame by means of an attachment 6.

The arrangement of the suction pipe 5 as shown in FIG. 1 is especially advantageous for fine cleaning of the conveyor belt 1. Here the suction pipe 5 removes the residual dirt on the conveyor belt 1 which could not be removed by the suction nozzle 10. This involves essentially the underside and the faces of the conveyor belt 1. The advantageous result of cleaning these surfaces is that the conveyor belt does not convey any adhering dirt particles to the spinning stations of the open-end spinning machine. This prevents dirt particles, which detach themselves as a result of mechanical or pneumatic influences from the conveyor belt 1, from being carried back to the spinning station. Production of a clean, perfect yarn is thus assisted.

The slits 7 and 8 in the embodiment of FIG. 1 have substantially identical cross-sections. As a result free passage of the conveyor belt 1 through pipe 5 and uniform suction are ensured.

Figure 2:
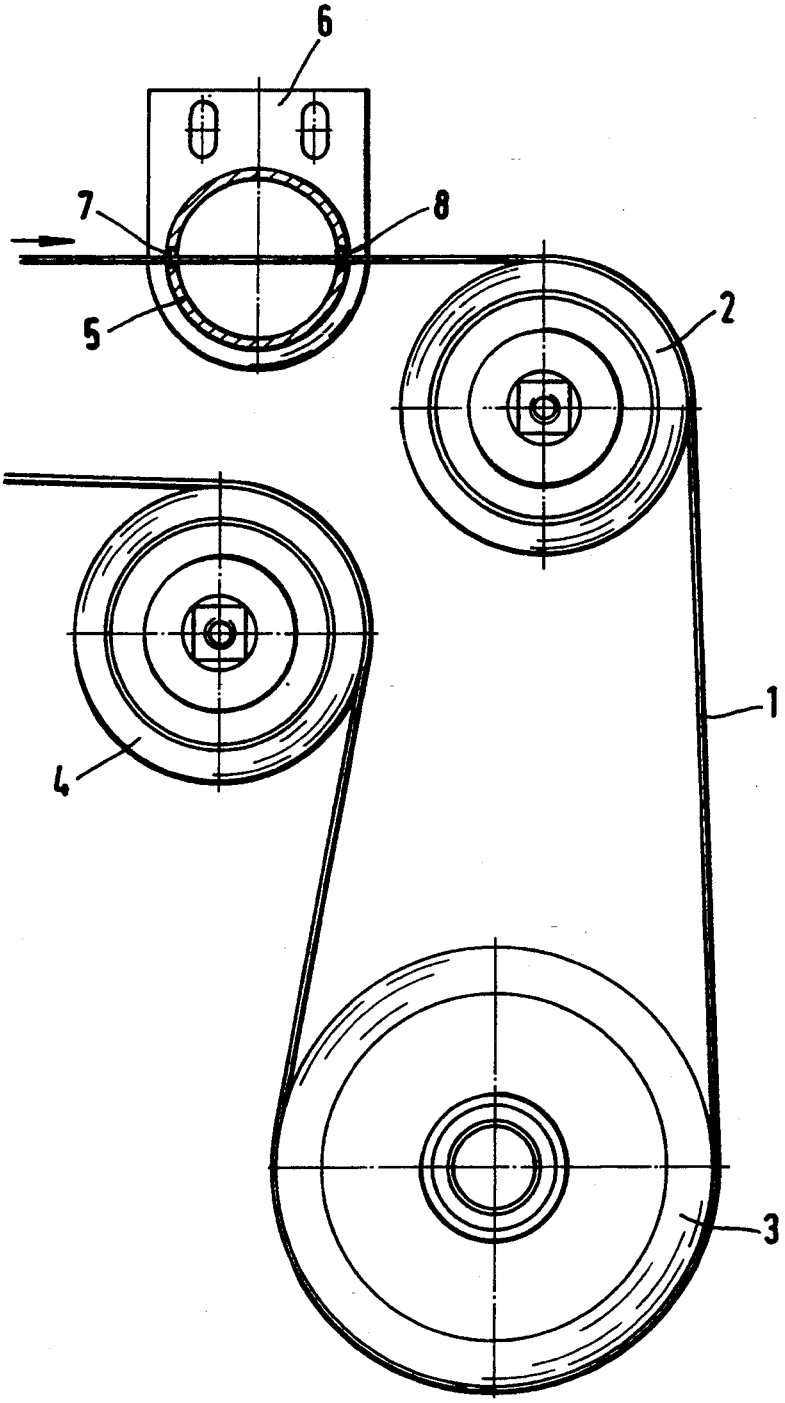

FIG. 2 shows an embodiment of the invention in which the suction pipe 5 ensures the complete suction of the conveyor belt 1. The cross-sections of the slits 7 and 8 are selected so that the dirt particles conveyed on the conveyor belt 1 can be sucked away. In function of the expected quantity and particle size of the dirt for instance, it is advantageous for the slit 7 to be of greater height, with respect to the conveyor belt 1, than slit 8. This ensures that the dirt particles are introduced into the suction pipe 5 and are sucked away. The smaller slit 8 causes a smaller amount of suction air to be necessary and furthermore enhances scraping of the dirt particles against the slit edge of slit 8. The removal of the dirt particles occurs in the direction of the arrow, corresponding to the direction of movement of the conveyor belt 1.

The invention is not limited to the embodiments shown. The suction pipe 5 can be used just as well for a flat belt drive on, for example, a draw frame. On a draw frame the dust and fiber density in the immediate proximity of the machine is very high. On the other hand, the greatest precision is required in the translation ratios, in particular in driving the draw-frame rollers. If fiber accumulations are deposited between deflection rollers or drive rollers and the drive belt, the translation ratio changes and the drafting of the fiber sliver does not meet requirements. For operation in the draw frame, it is therefore advantageous for the flat belts to be especially clean. The cleaning device according to the invention is very advantageous for this application. The construction of a device according to the invention in a draw frame is shown as in FIGS. 1 and 3. Instead of the conveyor belt 1, a flat belt is used in this case. A suitable flat belt drive for a draw frame is shown in DE 39 34 576 A1.

Figure 3:
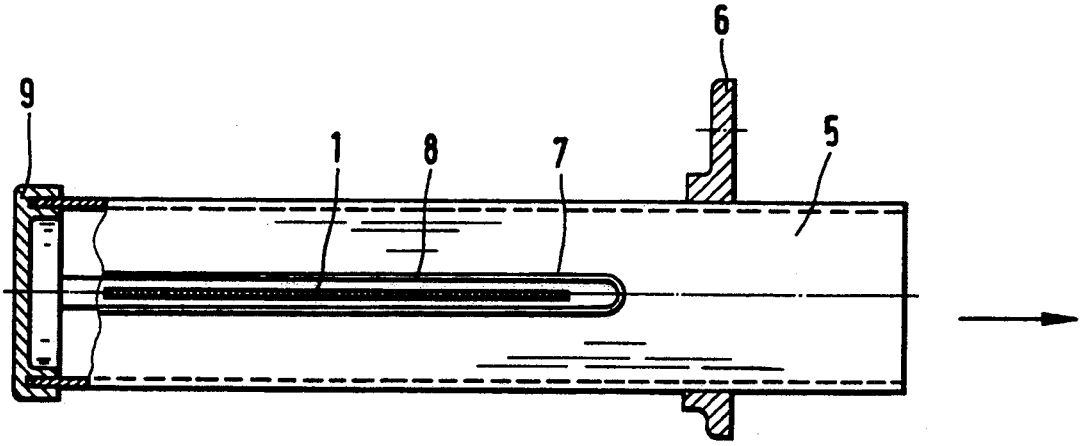
FIGS. 3 and 4 each show a suction pipe configured according to the invention.

FIG. 3 shows a suction pipe 3 according to the invention in detail. The suction pipe 5 is attached to a machine, which is not shown, by means of attachment 6. The end of the suction pipe 5 away from the suction point is slit. The slits 7 and 8 are designed so that the conveyor belt 1 can be taken through them. The width of the slits 7 and 8 must be selected so that the conveyor belt 1 can be subjected to suction on its lateral face. The heights of slit 7 and 8 should be as low as possible. This is to ensure that air consumption to subject the conveyor belt 1 to suction can be reduced to a minimum. In the embodiment shown, the slit 7 is higher than the slit 8 behind it. A larger intake opening for dirt particles is thus achieved. With a reversible conveyor belt 1, i.e. with a conveyor belt which can feed dirt particles to the suction pipe 5 in one direction as well as the other, it is advantageous for the slits 7 and 8 to be of equal height. In an advantageous embodiment according to FIG. 3, the end of the suction pipe 5 is closed by a cover 9. Unnecessary suction of air through the suction pipe end is thereby avoided, and on the other hand particularly easy introduction of the generally endless conveyor belt 1 is thus ensured. The conveyor belt 1 can be introduced into the slit 7 and 8 laterally when the cover 9 is removed. The cover 9 ius then placed over the end of the suction pipe 5 and closes it off.

Figure 4:
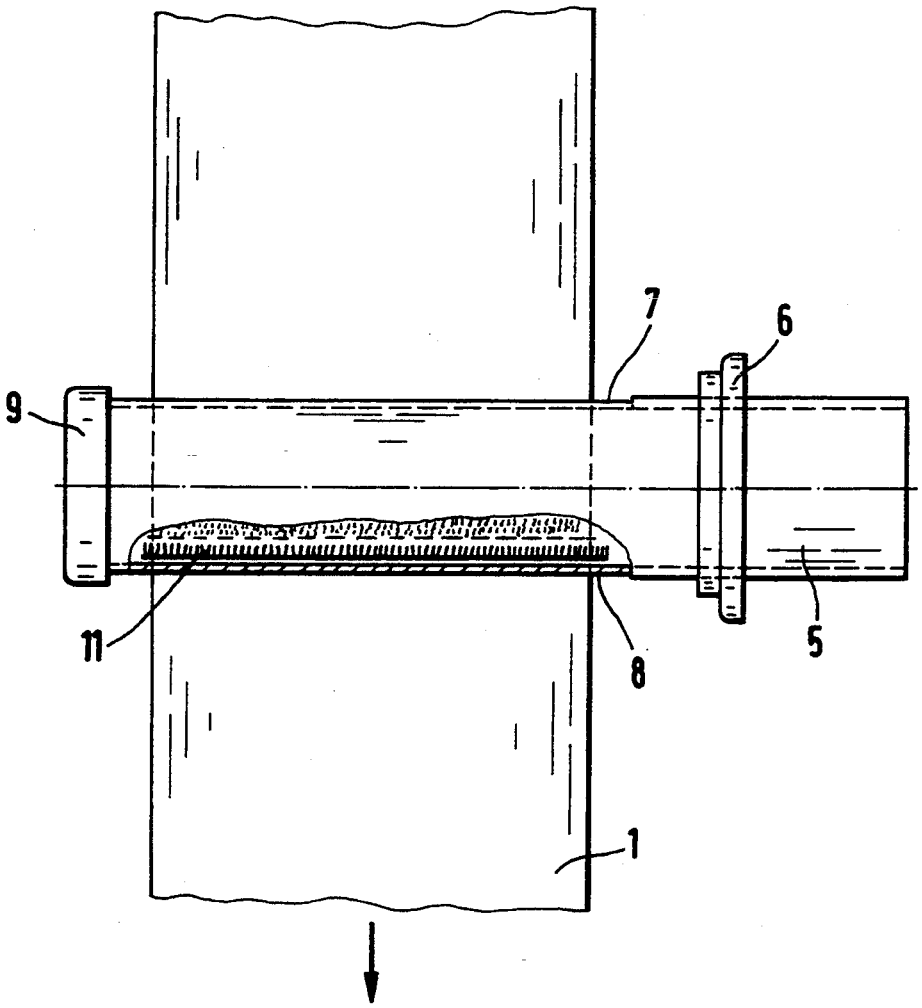

FIG. 4 shows an embodiment of a suction pipe 5 in which the slit 8 is provided with a brush 11. When the conveyor belt 1 moves in the direction of the arrow, this produces an excellent cleaning effect on the conveyor belt 1. The conveyor belt 1 is brought into contact with brush 11 and is constantly brushed off. The dirt brushed off from the conveyor belt 1 is sucked away directly by the suction pipe 5. The brush 11 advantageously attacks the upper side as well as the underside and also the lateral faces of the conveyor belt 1.

The suction pipe 5 is of course not limited to a round cross-section. It is thus also possible to make slits in a pipe with a rectangular cross-section and to subject a belt taken through these slits to suction and, thus, to clean it.

The invention also relates to conveyor or drive belts of machines other than the described spinning plant machines, in which much dirt is produced on the one hand, but where great precision and therefore cleanliness of the belt is required on the other hand. The belts to be cleaned can also be structured.

It will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

The invention claimed is:

1. A cleaning device for continuously cleaning a running belt of a textile machine, said device comprising a length of pipe disposed in the running path of the belt, said pipe comprising generally oppositely disposed slits formed therein through which the belt passes, said pipe connected to a suction means so that as the belt passes therethrough all sides of the belt are subjected to suction for removing dirt particles from all surfaces of the belt, said slit oriented as the entry slit for the belt comprising a greater height than said slit oriented as the exit slit for the belt, whereby relatively larger dirt particles carried by the belt are allowed to pass with the belt into said pipe.

2. The cleaning device as in claim 1, wherein said slits are oriented in an axial direction of said pipe.

3. The cleaning device as in claim 2, wherein said slits are defined at one of the ends of said pipe, whereby in the case of an endless belt said belt is fitted between said slits through said end of said pipe without breaking the endless belt.

4. The cleaning device as in claim 3, further comprising a cover fitted over said end of said pipe.

5. The cleaning device as in claim 1, further comprising a mechanical cleaning device disposed within said pipe and configured to mechanically agitate said belt within said pipe.

6. The cleaning device as in claim 5, wherein said mechanical cleaning device comprises a brush disposed within said pipe generally near said slit oriented as the exit slit for the belt.

7. The cleaning device as in claim 6, wherein said brush is configured to brush all sides of the belt passing through said pipe.

* * * * *